US006634533B2

(12) United States Patent
Thompson et al.

(10) Patent No.: US 6,634,533 B2
(45) Date of Patent: Oct. 21, 2003

(54) BACKPACK HIP BELT WITH SPLIT PADS AND SUPPORT BRIDGE

(75) Inventors: Jesse B. Thompson, Bozeman, MT (US); Gregory R. Garrigues, Bozeman, MT (US)

(73) Assignee: K-2 Corporation, Vashon, WA (US)

( * ) Notice: Subject to any disclaimer, the term of this patent is extended or adjusted under 35 U.S.C. 154(b) by 69 days.

(21) Appl. No.: 09/930,882

(22) Filed: Aug. 15, 2001

(65) Prior Publication Data

US 2003/0034372 A1 Feb. 20, 2003

(51) Int. Cl.[7] ..... A45F 3/04

(52) U.S. Cl. ..... 224/641; 224/262; 224/663; 602/19

(58) Field of Search ..... 224/637, 641, 224/660, 663, 262; 602/19

(56) References Cited

U.S. PATENT DOCUMENTS

| | | | | |
|---|---|---|---|---|
| 3,561,434 A | * | 2/1971 | Kilbey | 602/36 |
| 3,831,827 A | | 8/1974 | Olson | |
| 4,015,759 A | | 4/1977 | Dreissigacker et al. | |
| 4,475,543 A | * | 10/1984 | Brooks et al. | 602/19 |
| 4,479,595 A | | 10/1984 | Opsal | |
| 5,201,448 A | * | 4/1993 | Schue | 224/675 |
| 5,363,863 A | * | 11/1994 | Lelli et al. | 128/876 |
| 5,388,274 A | * | 2/1995 | Glover et al. | 2/338 |
| 5,487,498 A | | 1/1996 | Gleason | |
| 5,553,759 A | | 9/1996 | McMaster et al. | |
| 5,651,764 A | * | 7/1997 | Chiu | 602/36 |
| 5,725,139 A | | 3/1998 | Smith | |
| 5,950,886 A | * | 9/1999 | Maupin | 224/157 |
| 5,954,253 A | | 9/1999 | Swetish | |
| 6,024,265 A | | 2/2000 | Clements | |
| 6,038,747 A | | 3/2000 | Hamilton et al. | |
| 6,500,137 B1 | * | 12/2002 | Molino et al. | 602/19 |

FOREIGN PATENT DOCUMENTS

| | | |
|---|---|---|
| EP | 0 350 841 A2 | 1/1990 |
| FR | 2 666 969 A1 | 3/1992 |

* cited by examiner

*Primary Examiner*—Stephen K. Cronin
(74) *Attorney, Agent, or Firm*—Christensen O'Connor Johnson Kindness PLLC

(57) ABSTRACT

A hip belt (100) is disclosed having split left (130) and right (150) portions. The upper legs (131, 151) and lower legs (132,152) of the split portions are attached to adjustable straps (180, 184) such that the belt tension is distributed to both the upper and lower portions to facilitate a snug fit to the user. Transverse members (200) interconnect the respective upper and lower legs, maintaining the desired leg spacing. The transverse members are semi-rigid, flexible members, allowing the split belt to readily conform to the user's profile. Fastening the transverse members along the outer edges of the belt permits the legs to rotate to better conform to the user. In an embodiment of the hip belt (300) a plurality of transverse members are distributed along the length of the split portion of the belt.

19 Claims, 5 Drawing Sheets

BACKPACK HIP BELT WITH SPLIT PADS AND SUPPORT BRIDGE

FIELD OF THE INVENTION

The present invention relates to the field of backpacks, and in particular, to hip belts for backpacks.

BACKGROUND OF THE INVENTION

Conventional backpacks and similar load carrying devices are well known and in widespread use around the world. Wilderness hikers and backpackers, cross country skiers, hunters, and other outdoors enthusiasts almost invariably pack the necessities and niceties for their activities into a backpack typically having a pair of shoulder straps that permit the packed gear to be carried adjacent the users back. Special-purpose devices, have also been developed to enable individuals to more easily transport other equipment, for example, for portage of watercraft and the like. Backpacks have also found uses other than for sports-related activities, for example as a convenient form of luggage for travelers, and for carrying books, electronic gear, military equipment, and the like. The term "backpack," as used herein, should be understood to encompass all of these various load-carrying devices.

In many prior art backpacks, the pair of shoulder straps provide the only support elements for supporting the backpack on the user. This configuration, however, has been found to put undue and uncomfortable stresses on the user's back and shoulders. With the weight of the backpack centered behind the upright user, the user's shoulders are pulled backwards, which can become uncomfortable, and even result in injury to the user. Moreover, the walking motion can cause the backpack to sway back and forth and forward and backward, in some instances causing the lower portion of the backpack to repetitively bump into the user's torso, and causing the weight of the backpack to repeatedly shift away from the user. This can add to the discomfort of carrying even a relatively light backpack, particularly when carrying heavy loads and/or over several hours of hiking.

Most modern backpacks that are intended for carrying significant weight and/or for long times, therefore, include a hip belt or similar apparatus that attaches the backpack to the user's hips, usually near the lower end of the backpack. The hip belt provides several benefits. The hip belt transfers a portion of the backpack weight to the user's hips, relieving stress on the user's shoulders and back. It generally fixes the lower portion of the backpack next to the user, virtually eliminating swaying, and keeping the weight of the backpack close to the user.

Although the addition of a hip belt represents an improvement over backpacks having only shoulder straps, the hip belt itself can become uncomfortable. The hip belt is typically quite wide in order to distribute the load over a large area. In such prior art belts, however, the flexibility of the belt tends to result in concentrating the load in a fairly narrow region near the centerline of the hip belt, which is not optimal for user comfort. Moreover, the relatively large area over which the belt is located can become hot due to stress, friction, and lack of ventilation. Some prior art hip belts have attempted to overcome this problem by splitting the hip belt along a portion of its length. This split belt configuration provides two relatively narrow belts (for a portion of the belt length) rather than a singlewide belt, thereby improving ventilation and user comfort. In use, however, the split portions, or legs, of these split hip belt designs have a tendency to either spread apart more than is desired, resulting in one leg of the split belt carrying essentially the entire load, or coming together, thereby eliminating much of the benefit of the split belt design. There is therefore a need for an improved hip belt that is comfortable to the user, beneficially spreads the load, and improves ventilation around the belt.

SUMMARY OF THE INVENTION

It is an object of the present invention to provide a hip belt for transferring a portion of a carried load to a user's hips that is comfortable to the user.

It is a further object of the present invention to provide a hip belt having a split portion, whereby ventilation around the hip belt is enhanced.

The present invention is directed to an improved hip belt for backpacks and the like, the hip belt being adapted for transferring a portion of a carried to the user's hips. The hip belt attaches to the backpack and includes a belt portion that may be padded, and that wraps around the user's waist. The belt portion is split along at least a portion of the left and right sides. A front strap portion adjustably attaches the hip belt about the user's waist, preferably in a manner such that the desired tension is maintained in both the upper portion and the lower portion of the split belt. At least one semi-rigid transverse member interconnects the upper and lower portions of the split belt at an intermediate location.

In an embodiment of the present invention, the split hip belt comprises upper and lower portions that are approximately maintained at a desired separation.

In an embodiment of the present invention, the split hip belt flexibly conforms to the user, and thereby distributes the carried load over a comfortable area.

In an embodiment of the present invention, a split hip belt is adapted to maintain tension in both the upper leg and the lower leg of the hip belt during use.

In an embodiment of the invention, transverse members interconnecting the upper and lower portions of the split belt are elongate strips of a flexible material having an elongate stiffening groove.

In an embodiment of the invention, the transverse members connect to an upper edge of the upper portion of the belt and to a lower edge of the lower portion of the belt.

In an embodiment of the invention, a plurality of transverse members are provided on both the left and the right side of the hip belt.

In an embodiment of the invention, a pair of hip belt stabilizer straps are provided between the hip belt and the backpack and the hip belt, each stabilizer strap being located to pass over at least one of the transverse members.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
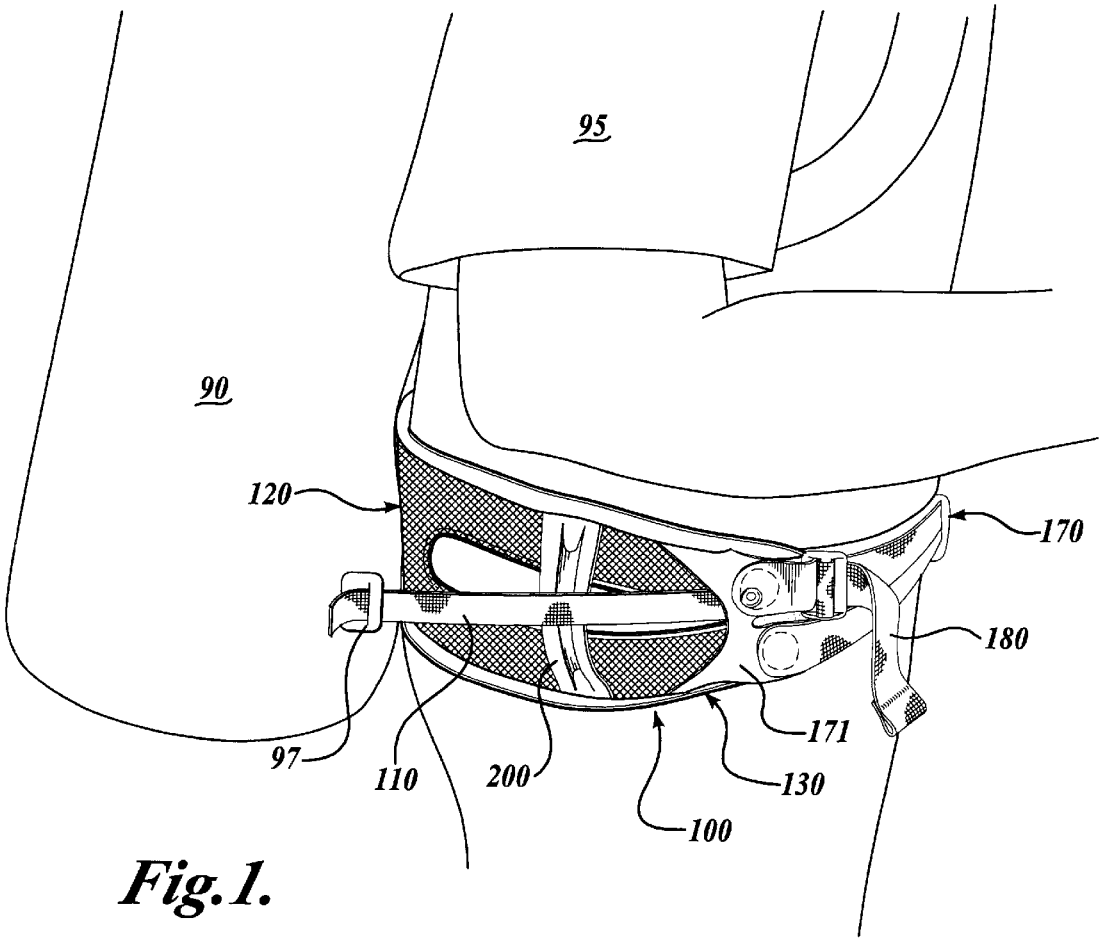
FIG. 1 is an environmental view showing a hip belt in accordance with the present invention attached to a backpack and user.

Referring now to FIG. 1, a hip belt 100 according to the present invention is shown in use on a user 95 with a conventional backpack 90. The hip belt 100 may be connected to the backpack 90 in any conventional manner as is well known in the art, for example, by fixedly attaching the hip belt 100 to a lower portion of the backpack 90, or removably attaching the hip belt 100 using straps, hook-and-loop type fasteners, snaps, buttons, or any other suitable attachment device or combinations thereof. A suitable attachment device will provide for a portion of the weight of the backpack 90 to be transferred to the user 95 through the hip belt 100 during use, while also preventing excessive motion between the backpack 90 and the user 95.

In the disclosed embodiment, a pair of stabilizer straps 110 (one shown) extend from the hip belt 100 to an attachment member 97 that is attached to a lower portion of the backpack 90. The stabilizer strap 110 can be adjustably tightened to permit the backpack 90 to be comfortably snugged up against the hip belt 100 and the user 95. The hip belt 100 includes a back portion 120, a split right portion 130, a split left portion 150 (see FIG. 2), and a front strap portion 170. It will be appreciated from FIGS. 1 and 2 that the back, right, left, and front portions 120, 130, 150, and 170 cooperatively define a generally hoop-shaped hip belt 100 that is adapted to be adjustably affixed about the user's hips. In the disclosed embodiment, a hook-and-loop type fastener panel 122 is affixed to the interior surface of the back portion 120 for attachment to the backpack 90, for example, to the lumbar support (not shown).

The split left and right portions 130, 150 each include an upper leg 131, 151 and a lower leg 132, 152, each leg connected at one end to the back portion 120 and at the other end to the front strap portion 170. In the disclosed embodiment, the split left and right portions 130, 150 and the back portion 120 are formed as an integral assembly. The right portion upper and lower legs 131, 132 are connected at or near their distal ends with a strap attachment panel 171. The strap attachment panel 171 is a generally flat and flexible, generally pi-shaped panel having an upper rearward leg 171A that attaches to the right portion upper leg 131, and a lower rearward leg 171B that attaches to the right portion lower leg 132. As seen most clearly in FIG. 3, the forward legs 171C, 171D of the attachment panel 171 adjustably attach to a first strap 180, wherein the first strap 180 has one end fixedly attached to the lower forward leg 171D of the attachment panel 171 and an opposite portion that adjustably attaches to the upper forward leg 171C of the attachment panel 171. A first buckle member 182 slidably engages the first strap 180 at an intermediate location.

A second strap attachment panel 173 attaches in a similar manner to the left side upper and lower legs 151, 152. In the disclosed embodiment the strap attachment panels 171, 173 are generally identical. The upper and lower rearward legs 173A, 173B of the second attachment panel 173 attach to the upper and lower legs 151, 152 of the hip belt left portion 150 and a second strap 184 attaches to the forward legs 173C, 173D. A second buckle member 186 that is adapted to releasably engage the first buckle member 182 is slidably disposed at an intermediate location on the second strap 184. Each of the straps 180, 184 is provided with a conventional strap keeper 187 that permits the user to adjust the effective length of the respective strap to provide the desired tension in the hip belt straps.

It will be appreciated that the hip belt 100 can be adjustably fastened about the user's waist. Moreover, the attachment panels 171, 173 that connect the adjustable straps 180, 184 to the left and right portions of the hip belt 130, 150 are connected such that a first end of each strap 180, 184 is connected to the corresponding lower leg 132, 152 of the hip belt left and right portions and the other end is connected to the corresponding upper leg 131, 151, whereby the tension in the straps 180, 184 will be distributed approximately evenly to both the upper and lower portions of the hip belt 100. In the preferred embodiment the buckle members 182, 186 are freely slidable on the associated straps 180, 184. When the adjustable straps 180, 184 are tightened, both the upper legs 131, 151 and the lower legs 132, 152 of the hip belt 100 will engage the user's hip, and therefore, the load carried by the hip belt 100 will be distributing between both the upper and lower legs of the hip belt 100, increasing the user's comfort by spreading out the load over a larger area. The present invention provides the advantage of spreading the load over a larger area while also allowing improved ventilation by splitting the belt longitudinally.

The circumference at the lower edge of the hip belt 100 is larger than the circumference at the upper edge of the hip belt 100, such that the hip belt 100 tapers to fit comfortable about the upper portion of the user's hip, with the narrower upper edge about the user's waist, whereby the vertical load carried by the hip belt 100 rests on the user's hips, and the hip belt 100 will not slide downwardly during use.

A semi-rigid transverse member 200 interconnects each pair of upper and lower legs at an intermediate location, a first transverse member 200 connecting upper leg 131 with lower leg 132 and a second transverse member 200 connecting upper leg 151 with lower leg 152. In the disclosed embodiment, the transverse members 200 are elongate strips of a suitable flexible material. Examples of suitable materials include semi-rigid strips of polypropylene, nylon, or polyester, although any suitably semi-rigid material may be utilized and is contemplated by the present invention.

Figure 2:
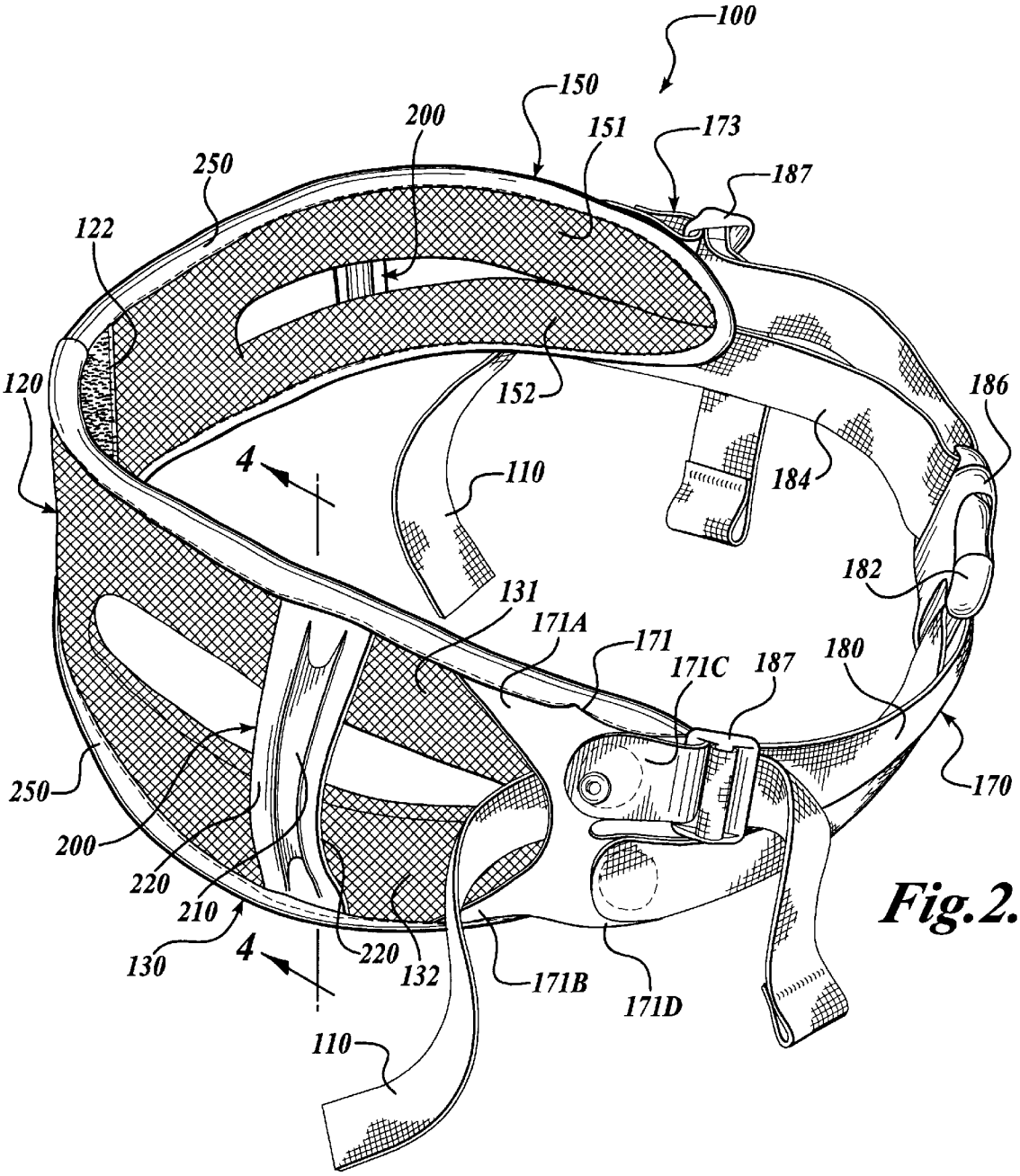
FIG. 2 is a perspective view of the hip belt shown in FIG. 1, with the hip belt shown in isolation.
Figure 3:
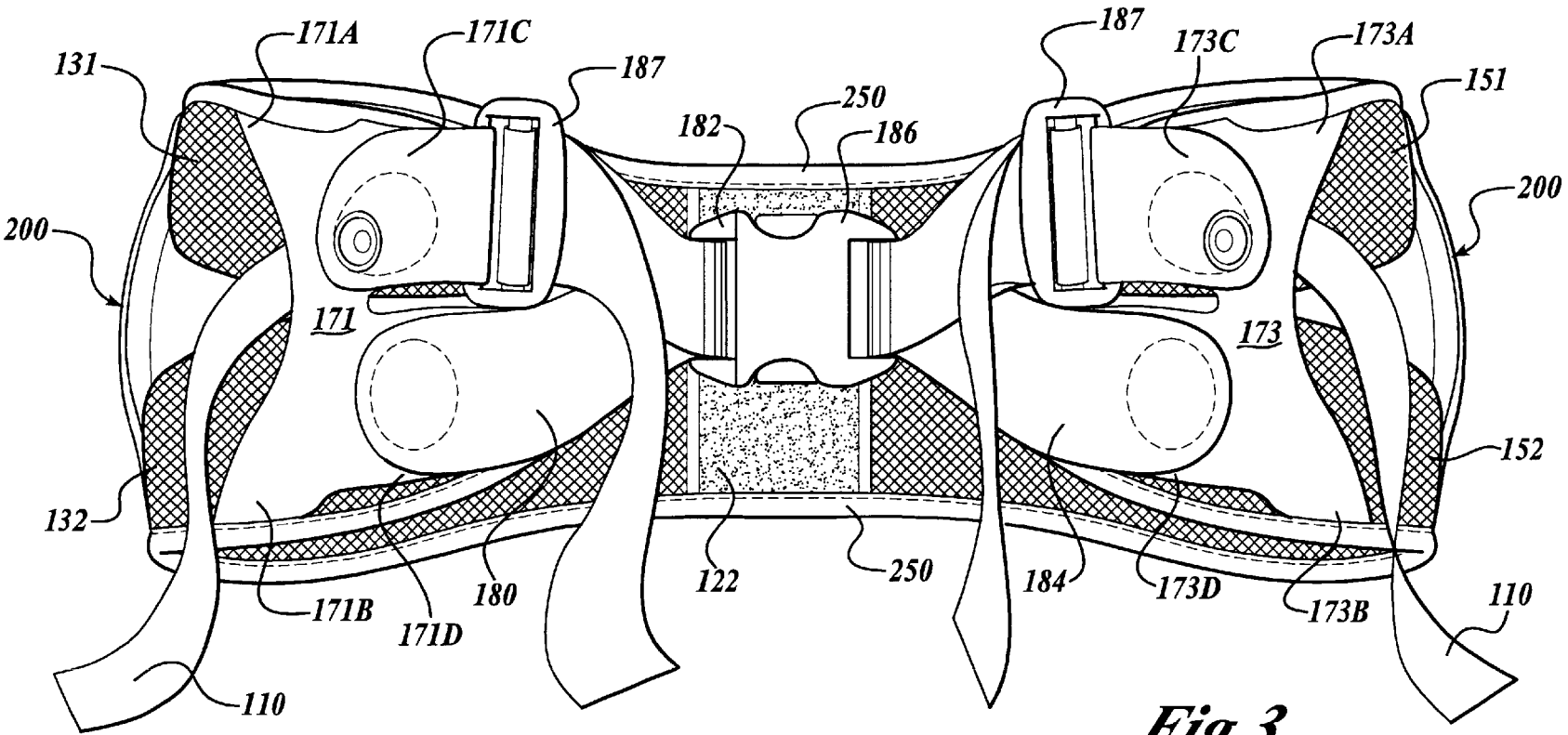
FIG. 3 is a front view of the hip belt shown in FIG. 1.

As seen most clearly in FIG. 2 and FIG. 3, in the disclosed embodiment of the hip belt 100 the transverse members 200 are provided with an outward curvature, such that the center part of the transverse member is disposed a distance away from the hip belt left and right portions 130, 150. This configuration permits the spacing between the legs on each side of the hip belt 100 to vary, the spacing accommodated by flexure of the transverse members 200. For example, the right portion upper and lower legs 131, 132 can move slightly further apart by the application of a force that tends to straighten out the curvature in the transverse member 200. Similarly, the right portion upper and lower legs 131, 132 can move closer together by flexing the transverse member 200 to greater curvature.

It will be readily apparent to one of skill in the art that the stiffness/flexibility of the transverse member 200 can be readily selected to a desired value by varying the width, thickness, and/or geometry of the transverse member 200. In the disclosed embodiment, for example, a longitudinal groove 210 in the transverse member 200, and thickened edge portions 220 increase the flexural stiffness of the transverse members 200 without significantly increasing the weight. It will also be appreciated that although elongate transverse members 200 are disclosed in the preferred embodiment, other shapes for the transverse members 200 are also contemplated by this invention. For example, X-shaped, oval-shaped, or more complicated-shaped transverse members could also be utilized.

Referring again to FIG. 1, in the preferred embodiment each stabilizer strap 110 is positioned such that when the stabilizer strap 110 is attached to the backpack 90, it passes over the transverse member 200 at or near midspan. The stabilizer strap 110 is taut between the attachment member 97 and the hip belt 100. Therefore, the stabilizer strap 110 will provide an inward force on the curved transverse member 200, effectively further increasing the stiffness of the transverse member 200.

Figure 4:
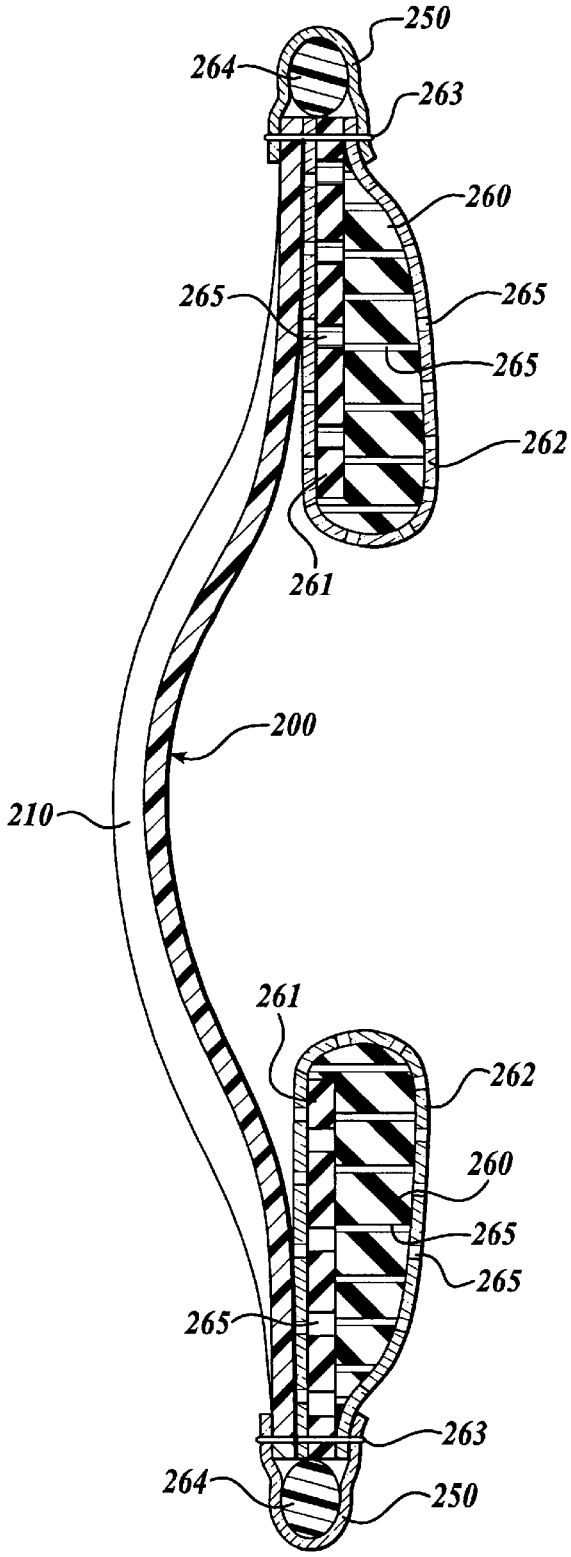
FIG. 4 is a cross-sectional view along break line 4—4 of FIG. 2.

In the preferred embodiment, a twill tape 250 is sewn around the periphery of the hip belt back, left and right portions 120, 130 and 150, the stitching also attaching the longitudinal members 200 and the attachment panels 171, 173 to the hip belt left and right portions 130, 150. As shown in FIG. 4, a cord 164 may also be provided at the edges. In particular, the transverse members 200 and the attachment panels 171, 173 are attached to the hip belt left and right portions 130, 150 at or near the upper edge of the upper legs 131, 151 and the lower edge of the lower legs 132, 152. By attaching the transverse members 200 and panels 171, 173 near the outer edges, the left and right portion legs 131, 132, 151, 152 of the hip belt are able to rotate generally about their longitudinal axis and thereby conform more closely to the hip shape of the user, and to more evenly spread out the carried load.

FIG. 4 shows a cross sectional view of the belt 100 taken along break line 4—4 of FIG. 2. In this embodiment the upper and lower legs 131, 151 include a core portion 260, such as a perforated closed-cell foam. Other materials may also be utilized, including both organic materials such as cotton, and inorganic materials such as suitable polymer materials. The core portion 160 is relatively thick and compliant, providing padding to the user and facilitating a snug fit about the user's hips. A relatively stiffer foam stiffener panel 261 is provided and preferably comprises a flexible and porous material such as a perforated closed-cell foam panel. The core 260 and stiffener panel 261 are generally surrounded by an outer panel 262 that is preferably a breathable fabric that is rugged enough to withstand the bumps and abrasions likely to occur during use. The twill tape 250 is stitched 263 around the edges to close the outer panel 262 and attach the transverse member 200 to the hip belt 100. In the preferred embodiment the core portion 260, stiffener panel 261, and outer panel 262 are breathable materials, for example, with perforations or a woven material, as indicated schematically in FIG. 4 by the horizontal channels 265, in order to enhance ventilation and improve the user's comfort.

Figure 5:
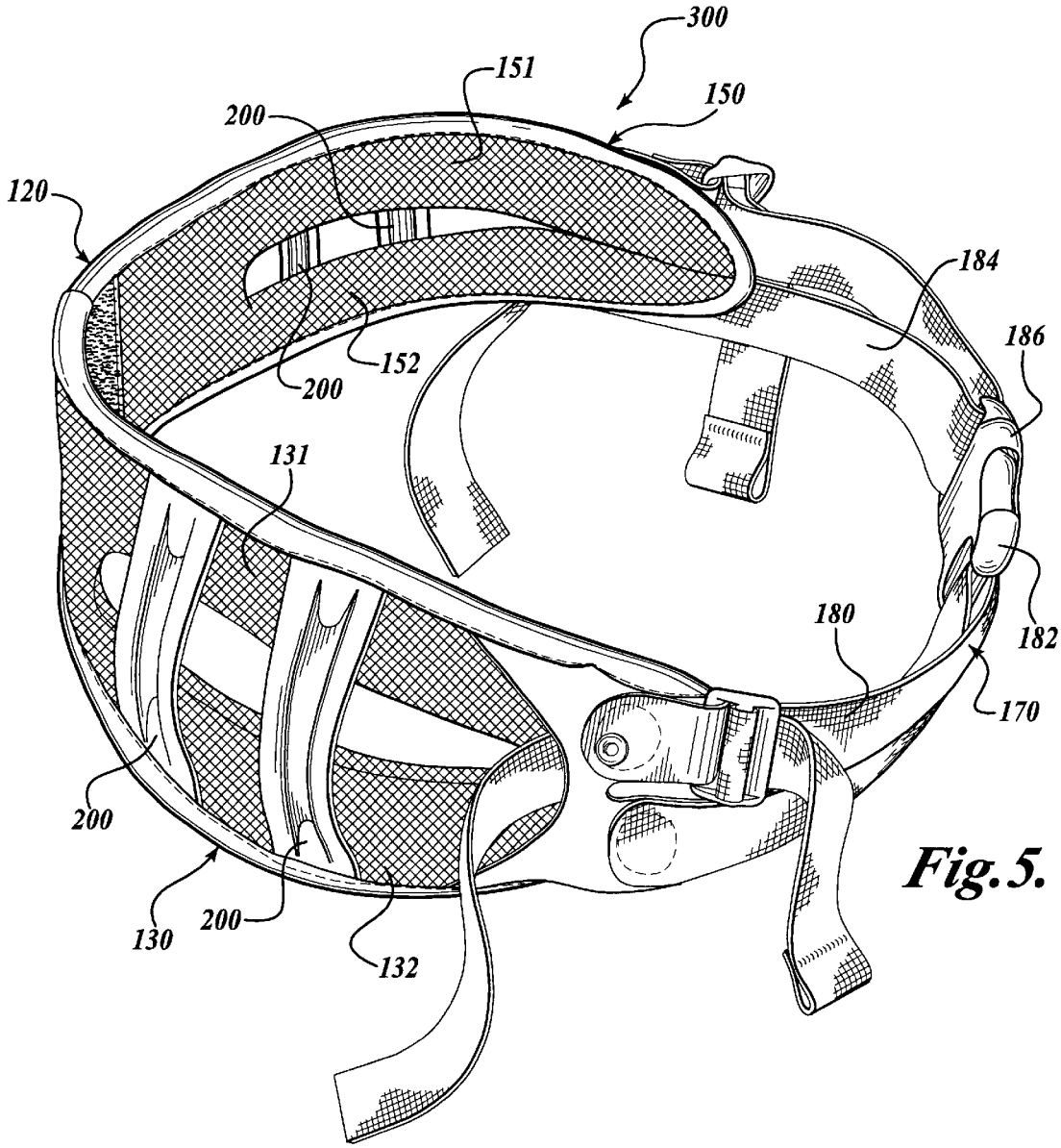
FIG. 5 is perspective view of a second embodiment of a hip belt in accordance with the present invention.

A second embodiment of a hip belt 300 according to the present invention is shown in FIG. 5. The hip belt 300 is similar to the first disclosed embodiment described above, including a back portion 120, a right portion 130, a left portion 150 and a front strap portion 170. The right portion 130 is split longitudinally along a portion of its length, defining an upper leg 131 and a lower leg 132, and the left portion 150 is similarly split longitudinally along a portion of its length, defining an upper leg 151 and a lower leg 152. The back, right, and left portions 120, 130, 150 preferably form an integral padded portion of the hip belt 300, wherein the hip belt 300 can be releasably closed and adjustably tightened with the front strap portion 170 comprising a first strap 180, a second strap 184, each strap having an associated buckle member 182, 186.

In this second embodiment, the hip strap 300 includes additional transverse members 200 spaced longitudinally over the split portion of the hip belt left and right portions 130, 150. Although two transverse members 200 are shown in FIG. 5 on each side of the hip belt 300, it will be readily apparent that more than two transverse members 200 could alternatively be used. The additional transverse members provide added stiffness and transverse strength between the upper and lower legs 131, 132 and 151, 152. It is also contemplated that by utilizing a additional transverse members 200 the length of the portion of the hip belt 300 that is split can be increased, including for example, a constructions wherein split extends for the entire longitudinal length of the back, right, and left portions, such that the upper leg of the hip belt is separate from the lower leg of the hip belt.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A hip belt for transferring a carried load to a user's hips, the hip belt comprising:

a back portion;

oppositely disposed left and right portions extending from the back portion, the left and right portions being split longitudinally thereby defining upper and lower legs, the upper and lower legs each having a distal portion;

a front strap assembly attached to the distal portions of the upper and lower legs, the front strap assembly adapted to adjustably attach the hip belt about a user's waist such that a tension is provided in the upper and lower legs;

at least one semi-rigid transverse stabilizing members interconnecting the left upper leg with the left lower leg; and at least one semi-rigid transverse member interconnecting the right upper leg with the right lower leg;

wherein the transverse members comprise elongate strips of a flexible material, each transverse member having an elongate stiffening groove.

2. The hip belt of claim 1, wherein the transverse members further comprise an upper edge and a lower edge, and wherein the upper edge of each transverse member attaches to an upper edge of one of the left and right portion upper legs and the lower edge of the transverse members attaches to a lower edge of one of the left and right portion lower legs.

3. The hip belt of claim 2, wherein the front strap assembly comprises a left strap and a right strap and the buckle comprises a left member and a right member, and further wherein the left strap is attached at a first strap location to the left portion upper leg and at a second strap location to the left portion lower leg assembly, the buckle left member being slidably disposed on the left strap between the first location and the second location, and further wherein the right strap is attached at a first strap location to the right portion upper leg and at a second strap location to the right portion lower leg assembly, the buckle right member being slidably disposed on the right strap between the first location and the second location, whereby tightening the strap assembly will produce tension in both the upper leg and the lower leg of each padded member portion.

4. A hip belt for transferring a carried load to a user's hips, the hip belt comprising:

a back portion;

oppositely disposed left and right portions extending from the back portion, the left and right portions being split longitudinally thereby defining upper and lower legs, the upper and lower legs each having a distal portion;

a front strap assembly attached to the distal portions of the upper and lower legs, the front strap assembly adapted to adjustably attach the hip belt about a user's waist such that a tension is provided in the upper and lower legs;

at least one semi-rigid transverse stabilizing members interconnecting the left upper leg with the left lower leg; and at least one semi-rigid transverse member interconnecting the right upper leg with the right lower leg;

wherein a plurality of semi-rigid transverse members are attached to each of the left and right portions.

5. A hip belt for transferring a carried load to a user's hips, the hip belt comprising:

a back portion;

oppositely disposed left and right portions extending from the back portion, the left and right portions being split longitudinally thereby defining upper and lower legs, the upper and lower legs each having a distal portion;

a front strap assembly attached to the distal portions of the upper and lower legs, the front strap assembly adapt&d to adjustably attach the hip belt about a user's waist such that a tension is provided in the upper and lower legs;

at least one semi-rigid transverse stabilizing members interconnecting the left upper leg with the left lower leg; and at least one semi-rigid transverse member interconnecting the right upper leg with the right lower leg;

further comprising a hook-and-loop type fastening panel disposed on an inner portion of the back portion for attachment to a backpack.

6. A hip belt for transferring a carried load to a user's hips, the hip belt comprising:

a back portion;

oppositely disposed left and right portions extending from the back portion, the left and right portions being split longitudinally thereby defining upper and lower legs, the upper and lower legs each having a distal portion;

a front strap assembly attached to the distal portions of the upper and lower legs, the front strap assembly adapted to adjustably attach the hip belt about a user's waist such that a tension is provided in the upper and lower legs;

at least one semi-rigid transverse stabilizing members interconnecting the left upper leg with the left lower leg; and at least one semi-rigid transverse member interconnecting the right upper leg with the right lower leg;

wherein the strap assembly further comprises left and right hip belt stabilizer straps, each stabilizer strap having a proximal end attached to the hip belt and a distal end adapted to be attached to the carried load.

7. The hip belt of claim 6, wherein each hip belt stabilizer strap is positioned to pass over at least one of the semi-rigid transverse members when the stabilizer strap is attached to the carried load.

8. A hip belt for transferring a carried load to a user's hips, the hip belt comprising:

a back portion;

oppositely disposed left and right portions extending from the back portion, the left and right portions being split longitudinally thereby defining upper and lower legs, the upper and lower legs each having a distal portion;

a front strap assembly attached to the distal portions of the upper and lower legs, the front strap assembly adapted to adjustably attach the hip belt about a user's waist such that a tension is provided in the upper and lower legs;

at least one semi-rigid transverse stabilizing members interconnecting the left upper leg with the left lower leg; and at least one semi-rigid transverse member interconnecting the right upper leg with the right lower leg;

wherein the left and right portion upper and lower legs comprise a resilient foam material.

9. A hip belt for transferring a carried load to a user's hips, the hip belt comprising:

a back portion;

oppositely disposed left and right portions extending from the back portion, the left and right portions being split longitudinally thereby defining upper and lower legs, the upper and lower legs each having a distal portion;

a front strap assembly attached to the distal portions of the upper and lower legs, the front strap assembly adapted to adjustably attach the hip belt about a user's waist such that a tension is provided in the upper and lower legs;

at least one semi-rigid transverse stabilizing members interconnecting the left upper leg with the left lower leg; and at least one semi-rigid transverse member interconnecting the right upper leg with the right lower leg;

wherein the transverse members comprise elongate members having an outward curvature.

10. A hip belt for transferring a carried load to a user's hips, the hip belt comprising:

a back portion;

oppositely disposed left and right portions extending from the back portion, the left and right portions being split longitudinally thereby defining upper and lower legs, the upper and lower legs each having a distal portion;

a front strap assembly attached to the distal portions of the upper and lower legs, the front strap assembly adapted to adjustably attach the hip belt about a user's waist such that a tension is provided in the upper and lower legs;

at least one semi-rigid transverse stabilizing members interconnecting the left upper leg with the left lower leg; and at least one semi-rigid transverse member interconnecting the right upper leg with the right lower leg;

wherein upper and lower legs of the left and right portions comprise proximal ends that are fixedly connected to each other and distal ends that are substantially unconnected from each other.

11. A hip belt of the type suitable for use with a backpack, the hip belt comprising:

a belt member including a left portion having a distal end, a right portion having a distal end, and a back portion interconnecting the left and right portions, wherein each of the left and right portions is split longitudinally for a substantial portion its length thereby forming an upper leg and a lower leg in each of the left and right portions;

a strap assembly having a left strap attached to the distal end of the belt member left portion, and a right strap attached to the distal end of the belt member right portion, the strap assembly further including a fastener for releasably connecting the left strap to the right strap;

at least one semi-rigid transverse member having an upper end secured to the belt member left portion upper leg and a lower end secured to the belt member left portion lower leg; and at least one semi-rigid transverse member having an upper end secured to the belt member right portion upper leg and a lower end secured to the belt member right portion lower leg;

wherein the semi-rigid transverse members comprise elongate strips of a flexible material each transverse member having an elongate stiffening groove.

12. The hip belt of claim 11, wherein the upper end of each transverse member attaches to an upper edge of the associated belt member upper leg and the lower end of each transverse member attaches to a lower edge of the associated belt member lower leg.

13. The hip belt of claim 12, wherein the fastener comprises a left member and a right member, and wherein the left strap is attached at a first strap location to the left portion upper leg and at a second strap location to the left portion lower leg assembly, the fastener left member being slidably disposed on the left strap between the first location and the second location, and further wherein the right strap is attached at a first strap location to the right portion upper leg and at a second strap location to the right portion lower leg assembly, the fastener right member being slidably disposed on the right strap between the first location and the second location, whereby tightening the strap assembly will produce tension in both the upper leg and the lower leg of each belt member portion.

14. A hip belt of the type suitable for use with a backpack, the hip belt comprising:

a belt member including a left portion having a distal end, a right portion having a distal end, and a back portion interconnecting the left and right portions, wherein each of the left and right portions is split longitudinally for a substantial portion its length thereby forming an upper leg and a lower leg in each of the left and right portions;

a strap assembly having a left strap attached to the distal end of the belt member left portion, and a right strap attached to the distal end of the belt member right portion, the strap assembly further including a fastener for releasably connecting the left strap to the right strap;

at least one semi-rigid transverse member having an upper end secured to the belt member left portion upper leg and a lower end secured to the belt member left portion lower leg; and at least one semi-rigid transverse member having an upper end secured to the belt member right portion upper leg and a lower end secured to the belt member right portion lower leg;

wherein a plurality of semi-rigid transverse members is attached to each of the left and right belt member portions.

15. A hip belt of the type suitable for use with a backpack, the hip belt comprising:

a belt member including a left portion having a distal end, a right portion having a distal end, and a back portion interconnecting the left and right portions, wherein each of the left and right portions is split longitudinally for a substantial portion its length thereby forming an upper leg and a lower leg in each of the left and right portions;

a strap assembly having a left strap attached to the distal end of the belt member left portion, and a right strap attached to the distal end of the belt member right portion, the strap assembly further including a fastener for releasably connecting the left strap to the right strap;

at least one semi-rigid transverse member having an upper end secured to the belt member left portion upper leg and a lower end secured to the belt member left portion lower leg; and at least one semi-rigid transverse member having an upper end secured to the belt member right portion upper leg and a lower end secured to the belt member right portion lower leg;

wherein the semi-rigid transverse members are disposed generally perpendicular to the upper and lower legs of the associated left and right portions of the belt member.

16. A hip belt of the type suitable for use with a backpack, the hip belt comprising:

a belt member including a left portion having a distal end, a right portion having a distal end, and a back portion interconnecting the left and right portions, wherein each of the left and right portions is split longitudinally for a substantial portion its length thereby forming an upper leg and a lower leg in each of the left and right portions;

a strap assembly having a left strap attached to the distal end of the belt member left portion, and a right strap attached to the distal end of the belt member right portion, the strap assembly further including a fastener for releasably connecting the left strap to the right strap;

at least one semi-rigid transverse member having an upper end secured to the belt member left Portion upper leg and a lower end secured to the belt member left portion lower leg; and at least one semi-rigid transverse member having an upper end secured to the belt member right portion upper leg and a lower end secured to the belt member right portion lower leg;

wherein the strap assembly further comprises left and right hip belt stabilizer straps, each stabilizer strap having a proximal end attached to the hip belt and a distal end adapted to be attached to the backpack.

17. The hip belt of claim 16, wherein each hip belt stabilizer strap is positioned to pass over at least one of the semi-rigid transverse members when the stabilizer strap is attached to the backpack.

18. A hip belt of the type suitable for use with a backpack, the hip belt comprising:

a belt member including a left portion having a distal end, a right portion having a distal end, and a back portion interconnecting the left and right portions, wherein each of the left and right portions is split longitudinally for a substantial portion its length thereby forming an upper leg and a lower leg in each of the left and right portions;

a strap assembly having a left strap attached to the distal end of the belt member left portion, and a right strap attached to the distal end of the belt member right portion, the strap assembly further including a fastener for releasably connecting the left strap to the right strap;

at least one semi-rigid transverse member having an upper end secured to the belt member left portion upper leg and a lower end secured to the belt member left portion lower leg; and at least one semi-rigid transverse member having an upper end secured to the belt member right portion upper leg and a lower end secured to the belt member right portion lower leg;

wherein each belt member left and right portion leg comprises a resilient foam material.

19. A hip belt of the type suitable for use with a backpack, the hip belt comprising:

a belt member including a left portion having a distal end, a right portion having a distal end, and a back portion interconnecting the left and right portions, wherein each of the left and right portions is split longitudinally for a substantial portion its length thereby forming an upper leg and a lower leg in each of the left and right portions;

a strap assembly having a left strap attached to the distal end of the belt member left portion, and a right strap attached to the distal end of the belt member right portion, the strap assembly further including a fastener for releasably connecting the left strap to the right strap;

at least one semi-rigid transverse member having an upper end secured to the belt member left portion upper leg and a lower end secured to the belt member left portion lower leg; and at least one semi-rigid transverse member having an upper end secured to the belt member right portion upper leg and a lower end secured to the belt member right portion lower leg;

wherein the transverse members comprise elongate members having an outward curvature.

* * * * *

UNITED STATES PATENT AND TRADEMARK OFFICE

CERTIFICATE OF CORRECTION

PATENT NO. : 6,634,533 B2
DATED : October 21, 2003
INVENTOR(S) : J.B. Thompson et al.

It is certified that error appears in the above-identified patent and that said Letters Patent is hereby corrected as shown below:

Title page,
Item [57], ABSTRACT,
Line 3, "(132,152)" should read -- (132, 152) --

Column 6,
Line 33, "stabilizing members" should read -- stabilizing member --

Column 7,
Lines 8, 28 and 49, "stabilizing members" should read -- stabilizing member --
Line 24, "adapt&d" should read -- adapted --

Column 8,
Lines 2, 28 and 48, "stabilizing members" should read -- stabilizing member --
Line 63, "portion its length" should read -- portion of its length --

Column 9,
Line 14, "flexible material each" should read -- flexible material, each --
Line 42, "portion its length" should read -- portion of its length --
Line 59, "traverse members is" should read -- traverse members are --

Column 10,
Lines 1, 28 and 59, "portion its length" should read -- portion of its length --
Line 38, "Portion" should read -- portion --

Column 11,
Line 18, "portion its length" should read -- portion of its length --

Signed and Sealed this

Second Day of March, 2004

JON W. DUDAS
*Acting Director of the United States Patent and Trademark Office*